US005907469A

United States Patent [19]

Kim et al.

[11] Patent Number: 5,907,469

[45] Date of Patent: May 25, 1999

[54] MULTIPLE CHARGED DEVELOPING GUN

[75] Inventors: Young-Kag Kim, Seoul; Won-Hee Lee, Kyungki-do, both of Rep. of Korea

[73] Assignee: Samsung Display Devices Co., Ltd., Kyungki-do, Rep. of Korea

[21] Appl. No.: 08/802,717

[22] Filed: Feb. 20, 1997

[30] Foreign Application Priority Data

Apr. 16, 1996 [KR] Rep. of Korea ..... 96-11391

[51] Int. Cl.[6] ..... B05B 5/053

[52] U.S. Cl. ..... 361/225; 361/226

[58] Field of Search ..... 361/225–228, 361/235; 239/690, 706, 708

[56] References Cited

U.S. PATENT DOCUMENTS

| | | | |
|---|---|---|---|
| 2,894,175 | 7/1959 | Lamm | 361/228 |
| 3,212,211 | 10/1965 | Bennett | 361/227 |
| 3,263,127 | 7/1966 | Point et al. | 361/227 |
| 3,498,541 | 3/1970 | Taylor, Jr. | 361/227 |
| 3,521,125 | 7/1970 | Nelson | 361/227 |
| 3,895,262 | 7/1975 | Ribnitz | 361/227 |
| 4,011,991 | 3/1977 | Masuda | 239/708 |
| 4,114,810 | 9/1978 | Masuda | 239/706 |
| 4,227,652 | 10/1980 | Itoh | 361/226 |
| 4,772,982 | 9/1988 | Nagasaka | 361/227 |
| 4,805,069 | 2/1989 | Nagasaka et al. | 361/227 |

FOREIGN PATENT DOCUMENTS

| | | |
|---|---|---|
| 230723 | 8/1987 | European Pat. Off. . |
| 261307 | 1/1972 | United Kingdom . |
| 283377 | 7/1972 | United Kingdom . |
| 388787 | 3/1975 | United Kingdom . |
| 505110 | 3/1978 | United Kingdom . |
| 542508 | 3/1979 | United Kingdom . |
| 022464 | 12/1979 | United Kingdom . |

*Primary Examiner*—Fritz Fleming
*Attorney, Agent, or Firm*—Christie, Parker & Hale, LLP

[57] ABSTRACT

A multiple charged developing gun provides a multiple charged electrode portion comprising a body and a flow path that is formed in an inner portion of the body and through which powder flows; an entrance, which is formed on one side of the body, connected to the flow path, and in which the powder flows through a powder supply line by being connected to a powder supply apparatus; an exit that is formed on the other side of the body, which is connected to the flow path that becomes gradually narrow; a multiple charged electrode portion that is disposed in an inner portion the body, which is near to the exit; and a cable, which connects the multiple charged electrode portion to a power supply apparatus. The multiple charged electrode portion comprises an electrode supply assembly, which is disposed in an inner portion of the body; a multiple electrode on which plural strip type electrodes is arranged at the electrode support assembly in forming a line toward the longitudinal direction of the body and the multiple electrode is connected to a power supply apparatus through the cable.

13 Claims, 7 Drawing Sheets

MULTIPLE CHARGED DEVELOPING GUN

BACKGROUND

The present invention relates to a multiple charged developing gun which applies an electrical charge by forming a multiple charged electrode portion that is made of plural electrodes.

In the prior art, the process for forming a phosphor face on CRT panels includes the applying of a black matrix which entails the steps of washing panel, application polymeric conductor and photoconductor layer, charging, exposure, black matrix developer, and fuser. Next, the process for forming a phosphor face includes the following steps for applying a phosphor material: P.C. charging, G exposure, G developer, fuser, P.C. charger, B exposure, B developer, fuser, R exposure, R developer, fuser. In this way, phosphor material comes to be applied through a method of electrophotographically manufacturing a screen assembly.

In the above process of forming a black matrix and each of the R, G, B phosphor materials through a method of electrophotographically manufacturing a screen assembly, the developing apparatus of the prior art includes: a body; a panel fixing portion placed on the upper part of the body; a developing gun that is a cylinder shaped and a strip type electrode is placed in the middle of the exit; a powder supply line which supplies powder for black matrix or R, G, B phosphor material (hereinafter referred to as just powder); a powder supply apparatus, connected to the powder supply line; an air supply line that supplies air to the developing gun and is installed separately from the powder supply line; an air supply apparatus connected to the air supply line; and an electric supply apparatus which supplies electricity to the strip type electrode inside the developing gun. The structure of the above panel fixing portion is formed so that it grounds the panel it secures.

In the above formation of the prior art developing apparatus, when the CRT panel, which is positively charged and is exposed, is fixed to the panel fixing portion, the powder supply apparatus and the air supply apparatus start operating, and through the powder supply line and the air supply line, powder and air is supplied to the developing gun and the electricity supply apparatus provides electricity to the electrodes of the developing gun.

The powder, which by following the flow of the air that is supplied to the developing gun gets sprayed out from the developing gun. While being forced out, the powder is electrically charged (to the same positive pole as the panel) by the corona discharge of the electrode fixed to the exit of the developing gun.

The panel fixed to the panel fixing portion has formed, an electrical line through the charged and un-charged portion. This is realized because the charged portion and the un-charged portion are formed in a determined pattern by the operations of charging and exposure, and because the conduction layer is grounded by the panel fixing portion. As a result, the powder, which is charged to the same pole as the panel and shot out of the developing gun, follows the electrical line and adheres to the un-charged portion and is developed in a determined pattern.

When using the prior art developing apparatus composed as in the above, because the powder sprayed through the developing gun is charged by the strip type electrode, the charged efficiency is diminished and an electric pole opposite to the electric pole charged on the panel exists. The powder having the opposite electric pole is adhered to a charged portion which developing is not necessary. Hence, it causes mixed colors and indistinct pictures. Namely, when developing the phosphors in the order of G—B—R, when G phosphor is developed, the mixed colors appear on the portion developing G or R phosphor because of adherence of G phosphor thereon. Furthermore, when developing the black matrix, it causes indistinct pictures that the powder is adhered on the portion which each phosphor is developed. In addition, powder charged to the opposite pole on the panel cohere with the powder charged to the same pole on the panel. Accordingly, because the size of the powder cohered is about 100 $\mu$m and they are adhered on the surface of the panel, the phosphor surface is not equal.

SUMMARY

The present invention has been made in an effort to solve the above problems.

It is an object of the present invention to provide a multiple charged developing gun, which includes a body; a flow path that is formed in the inner portion of the body and moves powder; an entrance, which is formed on one side of the body, connected to the flow path, and in which the powder is flown; an exit that is formed on the other side of the body, which is connected to the flow path that is gradually narrow; a multiple charged electrode disposed to the inner portion of the body near to the exit; a cable, which is connected to the multiple charged electrode applies electricity.

The multiple charged electrode portion of the multiple charged developing gun includes an electrode support assembly disposed to the inner portion of the body and a multiple electrode, which a multiple strip type electrode is arranged to the electrode support assembly toward the long direction of the body. The multiple electrode is connected to the powder supply apparatus, to which electricity is applied by the cable.

The multiple charged electrode portion may include a charger electrode that is disposed to the body. It is desirable that the charge electrode is disposed to the body after a resistance and a condenser is disposed to it.

It also may be desirable that an alternating current electrode for applying alternating current is disposed to the front or rear portion of the multiple charged electrode portion.

Besides the above, the multiple electrode of the multiple charged electrode portion may be formed by the way plural strip type electrodes are radially arranged on the electrode support assembly toward the center of the body.

Also, the multiple electrode of the multiple charged electrode portion may be formed on the electrode support assembly in a longitudinal direction of the body so that plural plate type electrodes in which plural slits are formed lie in other position to the slit, which is formed on a plate type electrode, which is next to the plate type electrode.

Furthermore, the multiple electrode of the multiple charged electrode portion may be formed the way the strip type electrode is formed on the electrode support assembly in forming a line toward the longitudinal direction of the body and plural plate type electrodes on which the slit is formed are arranged to one side or both side of the strip type electrode.

In addition, the multiple charged electrode portion may include a first electrode that is fixed to the center of the flow path at predetermined distance from the body, and is a strip type electrode; a second electrode that is fixed outside the exit and is a plate type electrode; and a ground electrode fixed to the body that the first electrode is fixed. The first and second electrode are connected to the power supply apparatus, which applies electricity through the cable. In addition, a spiral-shaped air flow mouth that is connected to the air supply apparatus through the air supply line is formed to the entrance of the body.

Also, the multiple charged electrode portion may include a line electrode of strip type fixed to the center of the flow path of the body and a ground electrode fixed to the place to which the line electrode is fixed.

In addition, the multiple charged electrode portion may include more than a point electrode which are fixed to the center of the flow path of the body in the predetermined distance and more than a ground electrode is respectively fixed to the portion to which more than a point electrode are fixed.

In the above the multiple charged developing gun, the powder, which is flown into the entrance of the body through the powder supply line moves along the flow path, which is formed inside the body and is sprayed toward the panel fixing portion of the developing apparatus through the exit of the body.

When the powder is moved along the flow path, if the electricity is applied to the multiple charged electrode portion, which is disposed inside of the body and connected to the power supply apparatus through the cable, then the powder is charged during passing through the multiple charged electrode portion. At this time, according to the invention, because the strip type electrode is in use the multiple electrode, which is fixed to longitudinal direction of the body, the corona discharge is generated in each strip type electrode and the powder is charged by passing through that portion and then there is no case that the powder is not charged or has opposite polarity.

When applying electricity to the multiple charged electrode portion, if it is electricity that includes pulses corresponding to about less than ten to several tens of GHz, which is contained in direct current corresponding to about less than ten to several tens of kV, applying it to the multiple electrode portion, the stable corona discharge is generated and then the powder is regularly charged.

If the ground electrode is fixed to the multiple charged electrode portion, the powder is applied on the panel because a magnetic field, which is formed by the corona discharge generated in the multiple electrode, can decrease influence toward the outside at a minimum.

Furthermore, if the AC electrode is disposed in front or rear of the multiple charged electrode portion, the unequal charged powder collides with each other. Accordingly, an charged amount of the powder particles comes to be equal and particles of negative-polarity get removed.

In addition, when forming radially the multiple electrode of the multiple charged electrode portion, the powder, which passes through the corona discharge layer is fully charged because the full corona discharged layer is formed on the flow path, which is placed near to the multiple electrode.

Also, because the multiple electrode is formed with what the plate type electrode which forms plural slits lies in other position to the slit, which is formed on is a plate type electrode, which is next to the plate type electrode and it is an impacter structure that the powder passing through the plate type electrode strikes the next plate type electrode, the charged efficiency of the powder is higher.

Also, when the multiple electrode of the multiple charged electrode portion is included with the strip type electrode, which is arranged in forming a line toward the longitudinal direction of the body; and the plate type electrode, which plural slits are formed, the charged efficiency of the powder is improved because the powder passes through the corona discharge layer and the plate type electrode of the impacter structure.

Also, when the multiple electrode of the multiple charged electrode portion is included with the first electrode of the strip type and the second electrode of the plate type, the powder is firstly charged on the first electrode of a strip type and secondly charged on the second electrode of a plate type during passing through the magnetic field that is widely formed near the exit of the body, and, at this time, the powder having negative-polarity get removed. Accordingly, the powder is equally charged.

In addition, when a spiral-shaped air flow mouth is formed in the entrance of the body, because the spiral-shaped air flow mouth is formed in the entrance of the body, if air is flown into the air flow mouth through the air supply line in the air supply apparatus, vortex flow is formed inside the flow path. Accordingly, because the powder is moved along the vortex flow, contacted with the ion layer, and the ion is applied to the powder, the powder has polarity and then is better charged.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DESCRIPTION

A preferred embodiment of the present invention will now be described in detail with reference to the accompanying drawings.

Figure 1:
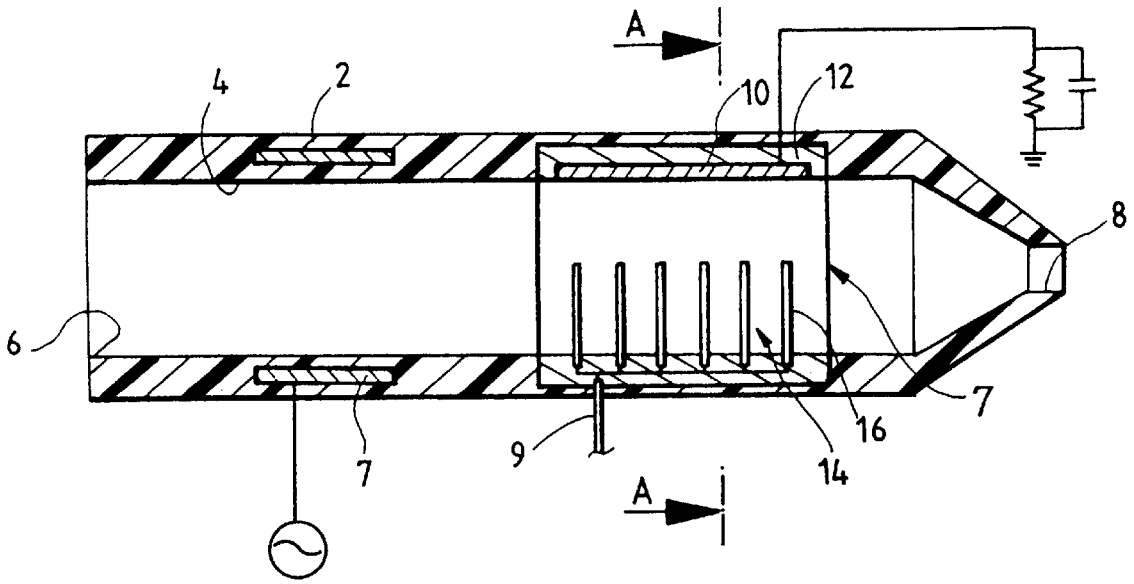
FIG. 1 is a cross-sectional view illustrating a multiple charged developing gun in accordance with a first preferred embodiment of the present invention.
Figure 2:
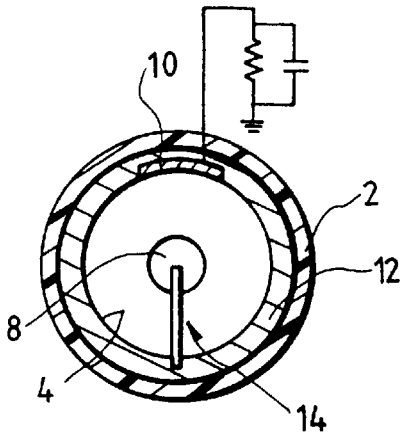
FIG. 2 is a cross-sectional view taken along line A—A in FIG. 1.

As illustrated in FIGS. 1 and 2, the present invention provides a multiple charged developing gun which includes a body 2; a flow path 4, that is formed in the inner portion of the body 2 and moves powder; an entrance 6, which is formed on one side of the body 2, connected to the flow path 4, and in which the powder flows; an exit 8, formed on the other side of the body 2, which is connected to the flow path that is gradually narrow; a multiple charge electrode 7 disposed to the inner portion of the body near to the exit; a cable 9 that is connected to the multiple charge electrode and applies electricity.

In the first embodiment of the invention, the multiple charged electrode portion includes an electrode support assembly 12, which is disposed inside the body 2 and a multiple electrode 14 to which plural strip type electrodes 16 are arranged at the electrode support assembly 12 and form a line toward the longitudinal direction of the body 2. The multiple electrode 14 is connected to a power supply apparatus(not shown) through the cable 9.

The plural strip type electrodes 16 may be disposed to the same height. But, if the plural strip type electrodes 16 are disposed to different height to each other, the charged efficiency is better.

The multiple charged electrode portion may include a ground electrode 10, which is disposed on the body 2. It is desirable that the ground electrode is made of a conductor with a thickness ranging from less than ten to several hundreds of $M\Omega/cm^3$. Or it is desirable that the ground electrode 10 is made of a conductor, which is less than ten of kΩ and is grounded after a resistance is connected parallel to a condenser, or it is grounded after connecting the resistance. The resistance value can be changed from 0–∞, as needed. Furthermore, it is desirable that the resistance value is from less than ten to several hundreds MΩ lest be overloaded.

The alternating current(AC) electrode 7 for applying AC may be disposed in the front or rear of the multiple charged electrode portion. In the preferred embodiment of the invention, the AC electrode 7 is disposed in the front of the multiple charged electrode portion, namely the entrance 6 which the powder flows into. However, the present invention is not limited to this construction. In other words, the AC electrode 7 can be disposed in the exit 8 or in both the exit 8 and the entrance 6.

Figure 3:
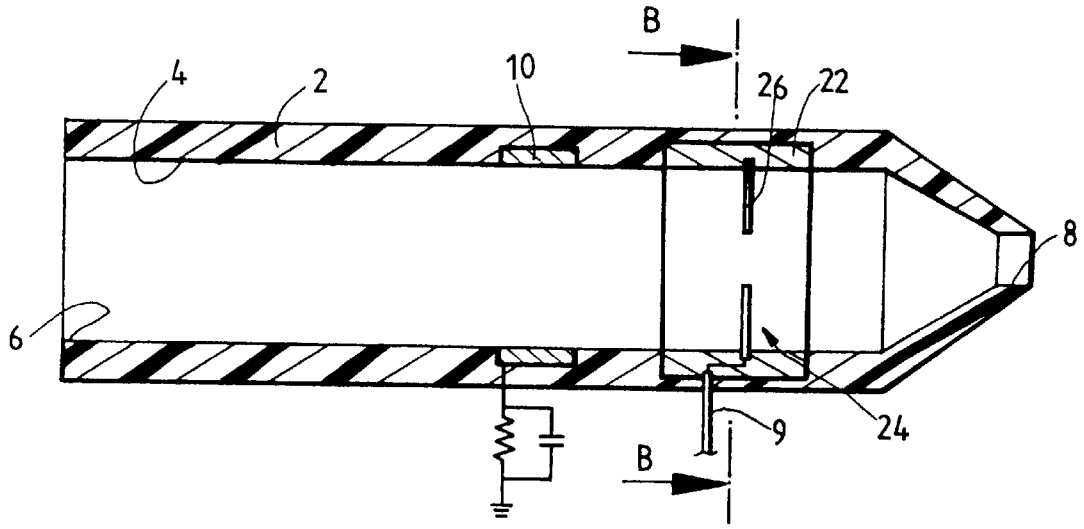
FIG. 3 is a cross-sectional view illustrating a multiple charged developing gun in accordance with a second preferred embodiment of the present invention.
Figure 4:
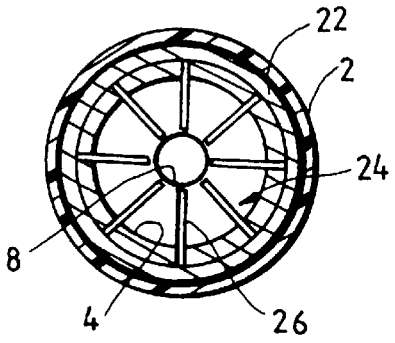
FIG. 4 is a cross-sectional view taken along line B—B in FIG. 3.

As illustrated in FIGS. 3 and 4, the preferred second embodiment of the present invention has the same structure as the first preferred embodiment except for the multiple charged electrode portion. Accordingly, only the structure of the multiple charged electrode portion will now be described in detail, except for when similar to the first embodiment. In the preferred second embodiment of the present invention, the multiple charged electrode portion includes an electrode support assembly 22, which is disposed inside of the body and a multiple electrode 24, to which plural strip type electrodes 26 are radially arranged on the electrode support assembly 22 toward the center of the body 2. The multiple electrode 24 is connected to the power supply apparatus through the cable 9.

The second preferred embodiment is basically the same as the first preferred embodiment and it is also desirable that the ground electrode 10 is disposed on the body portion on which the multiple electrode 24 is disposed. The ground electrode 10 of the second preferred embodiment has the same structure as the first preferred embodiment.

Not shown in drawings of the second preferred embodiment, it is desirable to install the AC electrode 7 here as in the first preferred embodiment.

Figure 5:
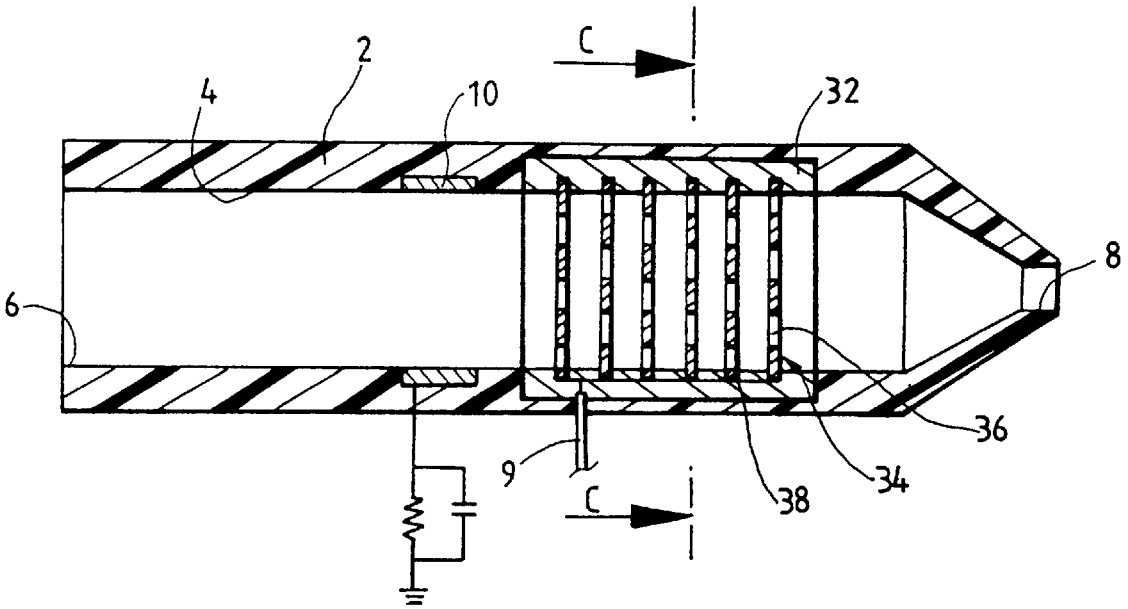
FIG. 5 is a cross-sectional view illustrating a multiple charged developing gun in accordance with a third preferred embodiment of the present invention.
Figure 6:
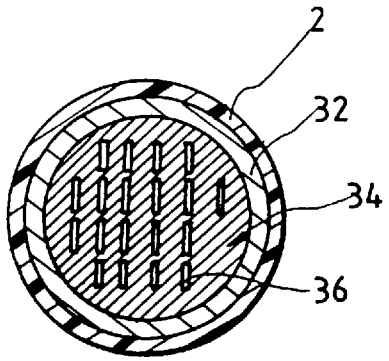
FIG. 6 is a cross-sectional view taken along line C—C in FIG. 3.

In addition, as illustrated in FIGS. 5 and 6, the third preferred embodiment of the invention has the same structure as the first preferred embodiment except the structure for the multiple charged electrode portion. Accordingly, only the composition of the multiple charged electrode portion will now be described in detail, except for when similar to the first embodiment. In the third preferred embodiment of the invention, the multiple charged electrode portion includes an electrode support assembly 32 disposed inside the body 2 and a multiple electrode 34, which is arranged in the longitudinal direction of the body 2 so that plural plate type electrodes 38 in which plural slits 36 are formed, lie in a different position than the slits 36, which are formed on a plate type electrode 38 and are next to the plate type electrode 38. The multiple electrode 34 is connected to the power supply apparatus through the cable 9.

The third preferred embodiment of the invention is the same as the first preferred embodiment in that it is desirable that the ground electrode 10 is disposed on the body portion on which the multiple electrode 34 is disposed. The ground electrode 10 of the third preferred embodiment has the same structure as the first preferred embodiment.

Not shown in drawings. of the third preferred embodiment, it is desirable to install the AC electrode 7.

Figure 7:
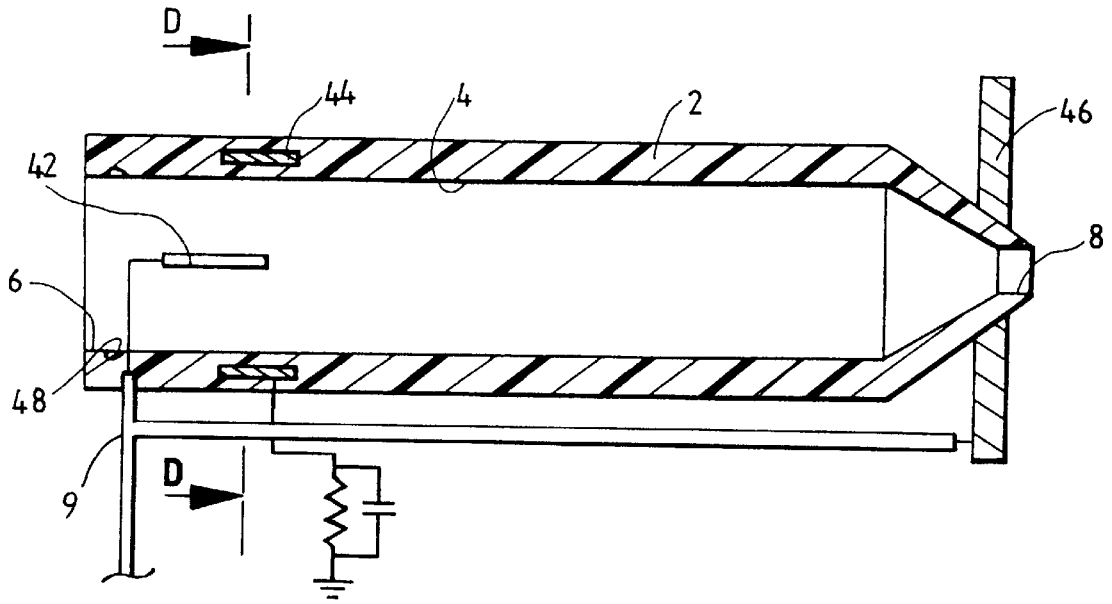
FIG. 7 is a cross-sectional view illustrating a multiple charged developing gun in accordance with a fourth preferred embodiment of the present invention.
Figure 8:
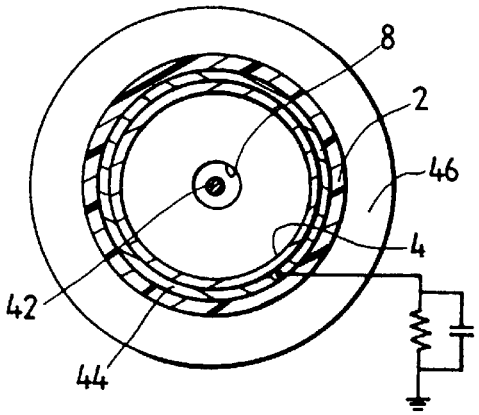
FIG. 8 is a cross-sectional view taken along line D—D in FIG. 7.
Figure 9:
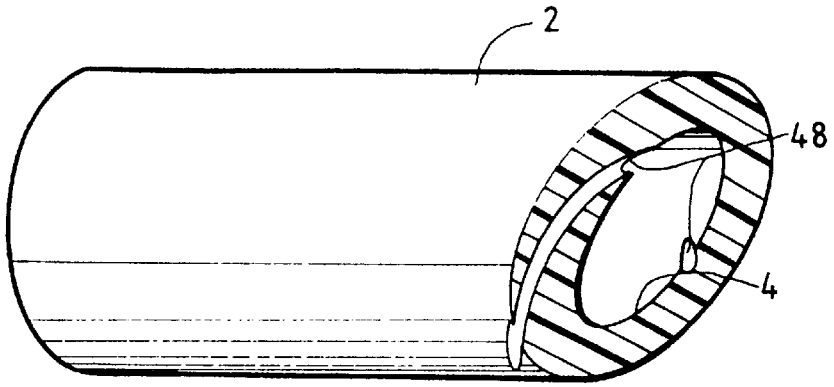
FIG. 9 is a perspective view illustrating an inclined section along an air flow mouth of a multiple charged developing gun in accordance with a fourth preferred embodiment of the present invention.

In addition, as illustrated in FIGS. 7 to 9 showing a fourth preferred embodiment, the multiple charged electrode portion includes a first electrode 42 that is fixed to the center of the flow path 4 at predetermined distance from the entrance 6 of the body 2, and is a strip type electrode; a second electrode 46 that is fixed outside the exit 8 of the body 2 and is a plate type electrode; and a ground electrode 44 fixed to the body 2 in the part that the first electrode 42 is fixed. The first 42 and second electrode 46 are connected to the power supply apparatus, which applies electricity through the cable 9. In addition, a spiral-shaped air flow mouth 48 is formed in the entrance 6 of the body 2. The air flow mouth 48 is connected to the air supply apparatus(not shown) through the air supply line(not shown).

Not shown in drawings. of the fourth preferred embodiment, it is desirable to install the AC electrode 7 here as in the first preferred embodiment.

Figure 10:
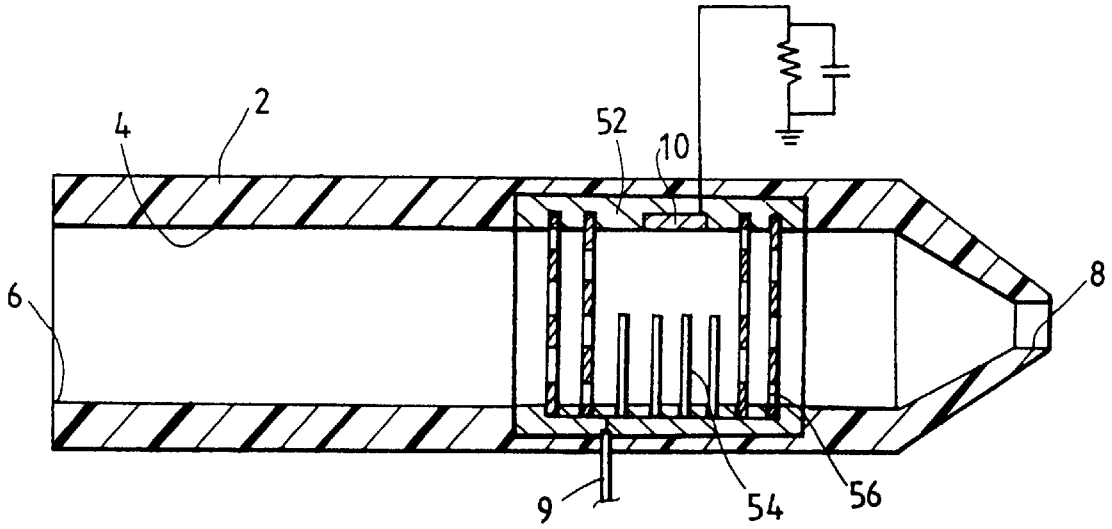
FIG. 10 is a cross-sectional view illustrating a multiple charged developing gun in accordance with a fifth preferred embodiment of the present invention.

As illustrated in FIG. 10 showing a fifth preferred embodiment, the multiple charged electrode portion includes an electrode support assembly 52 disposed inside the body 2; a first multiple electrode 54 which the strip type electrode is arranged in a line on the electrode support assembly 52 in the longitudinal direction of the body 2; and a second multiple electrode 56 which plural plate type electrodes on which slits are formed are arranged on both sides of the first multiple electrode 54. The first multiple electrode 54 and the second multiple electrode 56 are connected to the power supply apparatus through the cable 9. The first multiple electrode 54 has the same structure as the multiple electrode 14 of the first preferred embodiment and the second multiple electrode 56 has the same structure as the multiple electrode 34 of the third preferred embodiment.

The fifth preferred embodiment is about the same as the first preferred embodiment and it is also desirable that the ground electrode 10 is disposed on the body portion on which the first multiple electrode 54 is disposed. The ground electrode 10 of the fifth preferred embodiment has the same structure as the first preferred embodiment.

Not shown in the drawings of the fifth preferred embodiment, it is desirable to install the AC electrode 7 as in the first preferred embodiment.

Figure 11:
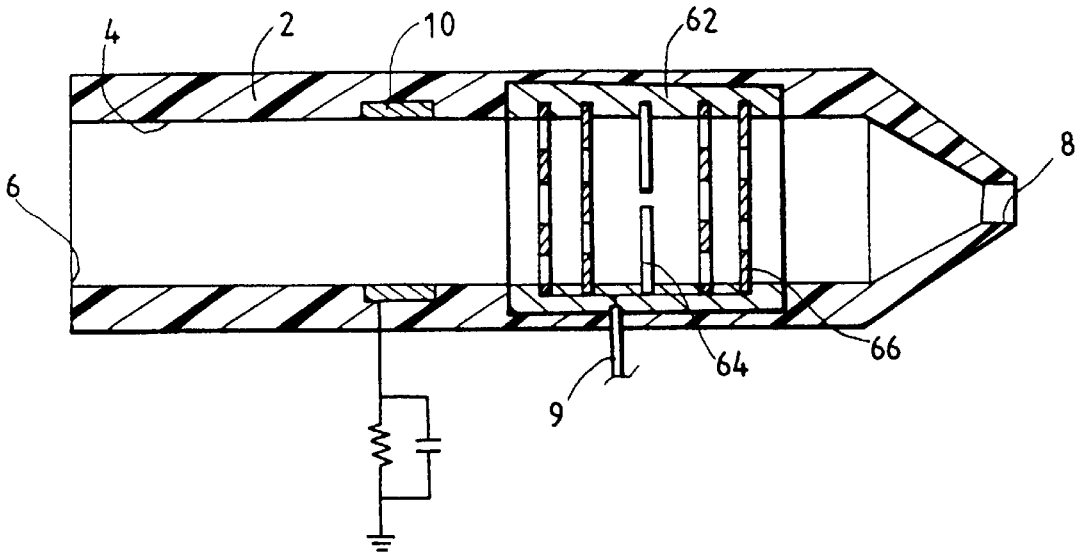
FIG. 11 is a cross-sectional view illustrating a multiple charged developing gun in accordance with a sixth preferred embodiment of the present invention.

As illustrated in FIG. 11 showing a sixth preferred embodiment, the multiple charged electrode portion includes an electrode support assembly 62 disposed inside the body 2; a first multiple electrode 64 which the strip type electrode is radially arranged on the electrode support assembly 62; and a second multiple electrode 66 having plural plate type electrodes on which slits are formed are arranged on both sides of the first multiple electrode 64. The first multiple electrode 64 and the second multiple electrode 66 are connected to the power supply apparatus through the cable 9. The first multiple electrode 64 has the same structure as the multiple electrode 24 of the first preferred embodiment and the second multiple electrode 66 has the same structure as the multiple electrode 34 of the third preferred embodiment.

The sixth preferred embodiment is basically the same as the first preferred embodiment and it is also desirable that the ground electrode 10 is disposed on the body portion on which the second multiple electrode 64 is disposed. The ground electrode 10 of the sixth preferred embodiment has the same structure as the first preferred embodiment.

Not shown in drawing of the sixth preferred embodiment, it is desirable to install the AC electrode 7 here as in the first preferred embodiment.

Figure 12:
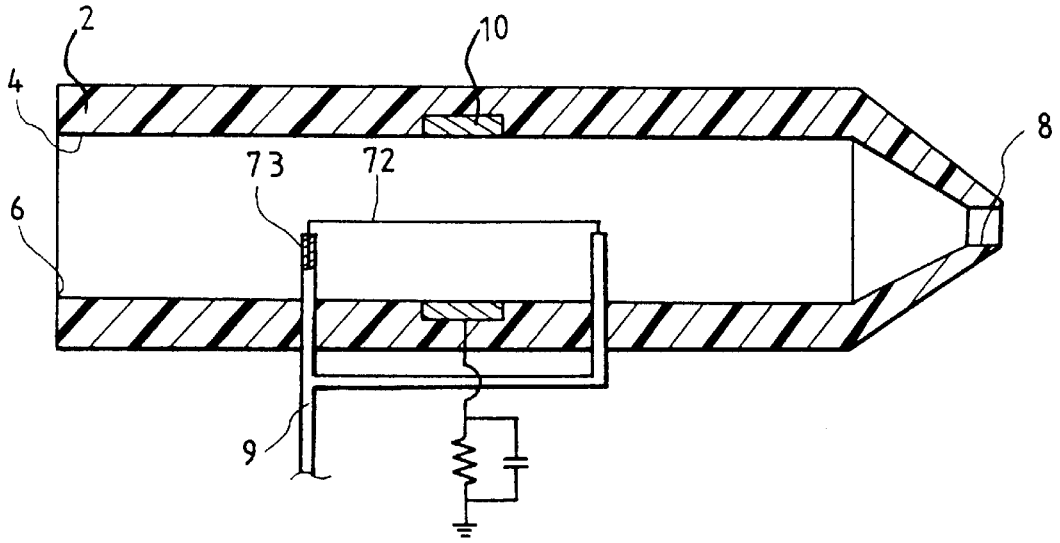
FIG. 12 is a cross-sectional view illustrating a multiple charged developing gun in accordance with a seventh preferred embodiment of the present invention.

As illustrated in FIG. 12 showing a seventh preferred embodiment, the multiple charged electrode portion includes a line electrode 72 of strip type fixed to the center of the flow path 4 and a ground electrode 10 fixed to the portion of the body 2 to which the line electrode 72 is fixed. Both sides of the line electrode 72 is covered with an insulator 73 except for the electrode portion in which corona discharge is generated. The line electrode 72, that has both sides are covered with insulator 73, is connected to the power supply apparatus through the cable (9). The ground electrode 10 has the same structure as the first preferred embodiment.

Not shown in the drawings of the seventh preferred embodiment, it is desirable to install the AC electrode 7 as in the first preferred embodiment.

A line electrode(72) and a ground electrode(10) is used in the above seventh preferred embodiment, however, the invention is not limited in that it can be constituted with more than two line electrodes and ground electrodes.

Figure 13:
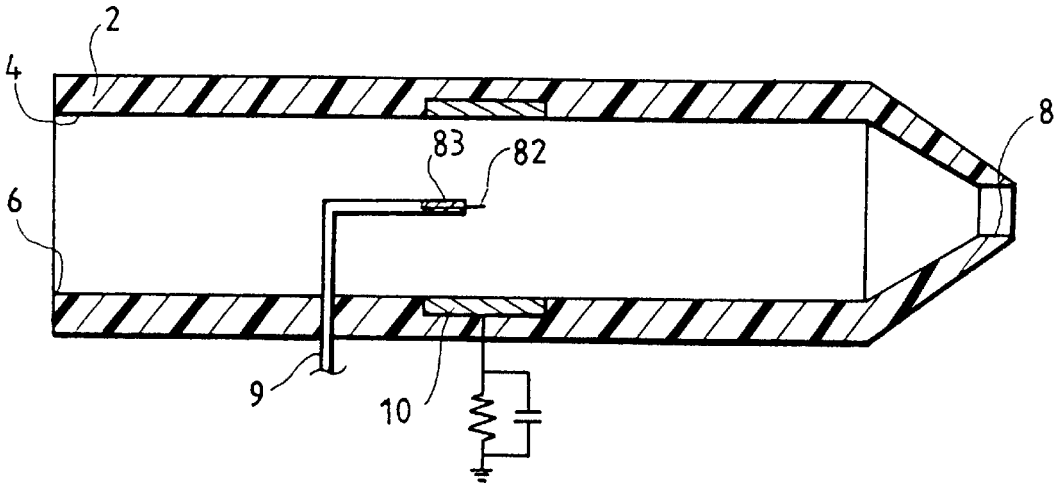
FIG. 13 is a cross-sectional view illustrating a multiple charged developing gun in accordance with an eighth preferred embodiment of the present invention.

As illustrated in FIG. 13 showing an eighth preferred embodiment, the multiple charged electrode portion includes a point electrode 82, which is point-shaped and fixed in the center of the flow path 4 and a ground electrode 10, which is fixed in the portion of the body that the point electrode 82 is fixed. The point electrode 82 is covered with an insulator 83 except for an end of the electrode portion in which the corona discharge is generated and is connected to the power supply apparatus through the cable (9). The ground electrode 10 has the same structure as the first preferred embodiment.

Not shown in the drawings of the eighth preferred embodiment, it is desirable to install the AC electrode 7 here as in the first preferred embodiment.

Figure 14:
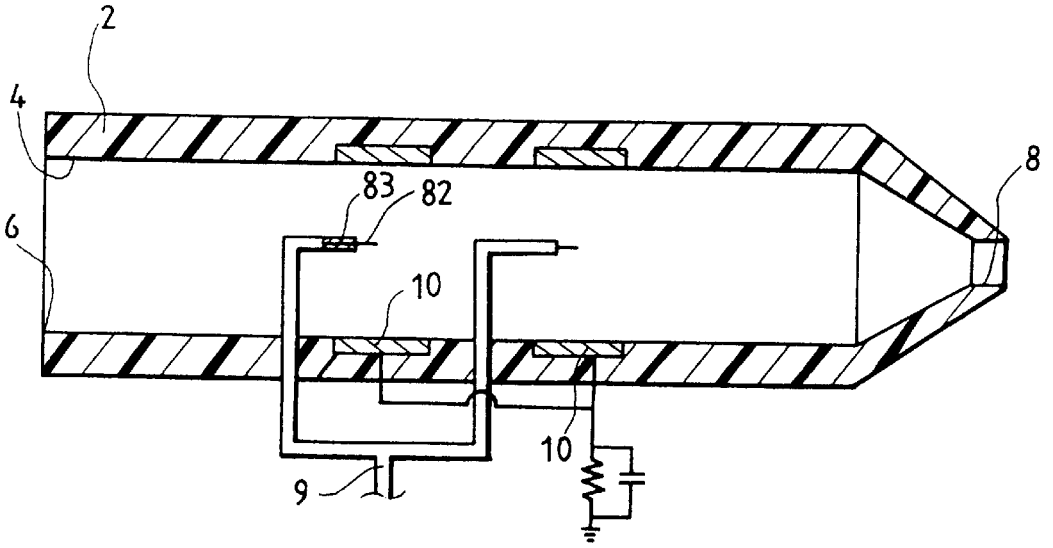
FIG. 14 is a cross-sectional view illustrating a multiple charged developing gun in accordance with an ninth preferred embodiment of the present invention.

A point electrode(82) and a ground electrode(10) is used in the eighth preferred embodiment, however, the invention is not limited in that it can be constituted with more than two point electrodes and ground electrodes as shown in FIG. 14.

Now, the process of the preferred embodiments for the multiple charged developing gun will be described in detail with the reference to the accompanying drawings.

The powder that is supplied into the entrance 6 of the body 2 through the powder supply line(not shown) is sprayed on a panel, which is fixed on a panel fixing portion of a developing apparatus(not shown) through the exit 8 of the body 2 along the flow path 4, which is formed inside the body 2.

When the powder is moved along the flow path 4, if electricity is applied to the multiple charged electrode portion, which is disposed inside the body 2 and is connected to the power supply apparatus through the cable 9, the powder is charged during passing through the multiple charged electrode portion. At this time, according to the multiple charged electrode portion of the first preferred embodiment, because corona discharge is generated in each strip type electrode by using the multiple electrode 14, which plural strip type electrodes 16 are fixed toward the long direction of the body 2, the powder, which passes through that position is repeatedly charged.

When applying electricity to the multiple charged electrode portion charged in the power supply apparatus, if it is electricity that includes pulses corresponding to about less than ten to several tens of GHz, which is contained in direct current corresponding to about less than ten to several tens of kV and applying it to the multiple electrode portion, stable corona discharge is generated and then the powder is regularly charged.

If the ground electrode 10 is fixed to the multiple charged electrode portion, the powder is applied on the panel because a magnetic field, which is formed by the corona discharge generated in the multiple electrode 14, can decrease influence toward the outside at a minimum.

Furthermore, if the AC electrode 7 is disposed in the front or rear of the multiple charged electrode portion, the unequal charged powder collides with each other. Accordingly, charged amount of the powder particles comes to be equal and particles of negative-polarity get removed.

A volume or frequency of a voltage that is applied to the AC electrode 7 can be different according to the flow condition of the powder particles. In general, voltage and frequency of AC voltage is less than ten kV and ranges from less than ten to several tens of kHz respectively.

Also, according to the multiple charged electrode portion of the second preferred embodiment, because the multiple electrode 24 is formed with plural strip type electrodes 26, which are radially arranged and the full corona discharged layer is formed on the flow path 6, which is placed near to the multiple electrode 24, the powder, which passes through the corona discharge layer is fully charged.

Also, according to the multiple charged electrode portion of the third preferred embodiment, because the multiple electrode 34 is formed with what the plate type electrode 38 which forms plural slits 36 lies in a different position to the slit 36 formed on a plate type electrode 38, which is next to the plate type electrode 38 and has an impacter structure that the powder passing through the plate type electrode 38 strikes the next plate type electrode 38, the charged efficiency of the powder is higher.

Also, according to the multiple charged electrode portion of the fourth preferred embodiment, the powder is first charged on the first electrode 42 of a strip type, and then charged on the second electrode of a plate type 46 while passing through the magnetic field that is widely formed near the exit of the body 2. Because the ground electrode 44 is fixed to the body 2, an ion layer is formed inside the body 2. In addition, because the spiral-shaped air flow mouth 48 is formed in the entrance 6 of the body 2, if air is flown into the air flow mouth 48 through the air supply line in the air supply apparatus, vortex flow is formed inside the flow path 4. Accordingly, because the powder is moved along the vortex flow, contacted with the ion layer, and the ion is applied to the powder, the powder gains polarity which allows it to be charged.

Furthermore, according to the fifth and sixth preferred embodiment, it is more efficient that the powder is repeatedly charged on the first multiple electrodes 54, 64 and the second multiple electrode 56, 66.

In the fifth and sixth preferred embodiment, the second multiple electrodes 56,66 are arranged on both sides of the first multiple electrodes 54,64. However, they can be arranged in either side of the first multiple electrode 54,64.

In the seventh and eighth preferred embodiment, because the line electrode 72 or the point electrode 82 is near to the ground electrode 10, a magnetic field is equally formed and the charged efficiency of the powder is improved.

In only the fourth preferred embodiment, the spiral-shaped air flow mouth 48 is formed, however, it can be included in the others for charged efficiency.

In addition, the multiple charged developing gun of the invention is described as an apparatus that is used in the developing process for the panel of the cathode-ray tube, however, it can be used as a coating gun for general coating processes.

Using the multiple charged developing gun of the invention when undertaking the developing processes, the charged efficiency of the powder is greatly improved. Accordingly, there is the prevention of the existence of un-charged particles or particles changing polarity. Finally, mixed color is prevented and distinction of color is improved.

What is claimed is:

1. A multiple charged developing gun comprising:

a body;

a flow path formed in an inner portion of the body for passing powder therethrough;

an entrance formed on one side of the body and connected to the flow path;

an exit formed on an opposite side of the body and connected to the flow path, said exit having a taper that narrows as the distance from the flow path increases;

a multiple charged electrode portion comprising a plurality of electrodes arranged in the inner portion the body near the exit; and a cable connected to the multiple charged electrode portion for connecting the multiple charged electrode to a power supply apparatus.

2. The multiple charged developing gun according to claim 1 wherein the multiple charged electrode portion comprises:

an electrode support assembly disposed in the inner portion of the body; and a multiple electrode comprising a plurality of electrodes radially arranged on the electrode support assembly toward the center of the body.

3. The multiple charged developing gun according to claim 1 further comprising a spiral-shaped air flow mouth formed at the entrance of the body.

4. The multiple charged developing gun according to claim 1 wherein the multiple charged electrode portion comprises:

a strip type electrode fixed to the center of the flow path of the body; and a ground electrode positioned proximal to the strip type electrode.

5. The multiple charged developing gun according to claim 1 wherein the multiple charged electrode portion comprises:

a plurality of point electrodes fixed at the center of the flow path at a predetermined distance from the body; and a plurality of ground electrodes each being positioned proximal a different one of the point electrodes.

6. A multiple charged developing gun, comprising:

a body;

a flow path formed in an inner portion of the body for passing powder therethrough;

an entrance formed on one side of the body and connected to the flow path;

a gradually narrowing exit formed on an opposite side of the body and connected to the flow path;

a multiple charged electrode portion disposed in the inner portion the body near the exit, the multiple charged electrode portion comprising:

an electrode support assembly disposed in the inner portion of the body; and a multiple electrode comprising a plurality of strip type electrodes arranged at the electrode support assembly in a line along the longitudinal direction of the body; and a cable connected to the multiple charged electrode portion for connecting the multiple charge electrode to a power supply apparatus.

7. A multiple charged developing gun, comprising:

a body;

a flow path formed in an inner portion of the body for passing powder therethrough;

an entrance formed on one side of the body and connected to the flow path;

a gradually narrowing exit formed on an opposite side of the body and connected to the flow path;

a multiple charged electrode portion disposed in the inner portion the body near the exit, the multiple charged electrode portion comprising:

an electrode support assembly disposed in the inner portion of the body; and a multiple electrode comprising a plurality of plate type electrodes arranged on the electrode support structure, each of the electrodes having a plurality of slits formed therein, the slits of each of the electrodes being arranged in different positions with respect to the slits of its respective adjacent electrodes; and a cable connected to the multiple charged electrode portion for connecting the multiple charge electrode to a power supply apparatus.

8. A multiple charged developing gun, comprising:

a body;

a flow path formed in an inner portion of the body for passing powder therethrough;

an entrance formed on one side of the body and connected to the flow path;

a gradually narrowing exit formed on an opposite side of the body and connected to the flow path;

a multiple charged electrode portion disposed in the inner portion the body near the exit, the multiple charged electrode portion comprising:

an electrode support assembly disposed in the inner portion of the body;

a first multiple electrode comprising a plurality of strip type electrodes arranged on the electrode support assembly along a line in the longitudinal direction of the body;

a second multiple electrode comprising a Plurality of plate type electrodes each having a plurality of slits formed therein, said plate type electrodes being arranged on both sides of the first multiple electrode; and a cable connected to the first and second multiple electrodes for connecting the multiple charge electrode to a power supply apparatus.

9. A multiple charged developing gun, comprising:

a body;

a flow path formed in an inner portion of the body for passing powder therethrough;

an entrance formed on one side of the body and connected to the flow path;

a gradually narrowing exit formed on an opposite side of the body and connected to the flow path;

a multiple charged electrode portion disposed in the inner portion the body near the exit, the multiple charged electrode portion comprising:

an electrode support assembly disposed in the inner portion of the body;

a first multiple electrode comprising a plurality of strip type electrodes radially arranged on the electrode support assembly;

a second multiple electrode comprising a plurality of plate type electrodes each having a plurality slits formed therein, said plate type electrodes being arranged on both sides of the first multiple electrode; and a cable connected to the first and second multiple electrodes for connecting the multiple charge electrode to a power supply apparatus.

10. A multiple charged developing gun, comprising:

a body;

a flow path formed in an inner portion of the body for passing powder therethrough;

an entrance formed on one side of the body and connected to the flow path;

a gradually narrowing exit formed on an opposite side of the body and connected to the flow path;

a multiple charged electrode portion disposed in the inner portion the body near the exit, the multiple charged electrode portion comprising:

an electrode support assembly disposed in the inner portion of the body;

a strip type electrode fixed at the center of the flow path at a predetermined distance from the body;

a plate type electrode fixed outside the exit;

a ground electrode fixed to the body; and a cable connected to the strip type electrode and the plate type electrode for connecting the multiple charge electrode to a power supply apparatus.

11. The multiple charged developing gun as in claim 1, 6, 2, 7, 8, or 9 further comprising a ground electrode fixed to the body, and a spiral-shaped air flow mouth formed at the entrance of the body.

12. The multiple charged developing gun as in claim 1, 6, 2, 7, 8, 9, 10, 3, or 4 further comprising an AC electrode installed beside the body portion.

13. A multiple charged developing gun comprising:

a body;

a flow path formed in an inner portion of the body for passing powder therethrough;

an entrance formed on one side of the body and connected to the flow path;

an exit formed on an opposite side of the body and connected to the flow path, said exit having a taper that narrows as the distance from the flow path increases;

a multiple charged electrode portion disposed in the inner portion the body near the exit; and a cable connected to the multiple charged electrode portion for connecting the multiple charged electrode to a power supply apparatus.

* * * * *